US005471771A

United States Patent [19]

Gilbert

[11] Patent Number: 5,471,771

[45] Date of Patent: Dec. 5, 1995

[54] METHOD AND APPARATUS FOR COOLING CHAIN TYPE DIGGERS

[76] Inventor: Jerry F. Gilbert, 1400 E. Highway 26, Grapevine, Tex. 76051

[21] Appl. No.: 258,048

[22] Filed: Jun. 10, 1994

[51] Int. Cl.[6] ..... E02F 5/06

[52] U.S. Cl. ..... 37/352; 37/355; 241/200; 299/34.01

[58] Field of Search ..... 37/352, 355, 357, 37/359, 367, 368, 369, 462, 463, 464; 198/493, 952; 241/66, 67, 200; 299/39, 81

[56] References Cited

U.S. PATENT DOCUMENTS

| | | | |
|---|---|---|---|
| 1,932,187 | 10/1933 | Radius . | |
| 2,360,316 | 10/1944 | Carlson | 37/355 |
| 2,655,362 | 10/1953 | Rollins | 262/28 |
| 2,735,667 | 2/1956 | Potvin | 37/352 |
| 2,756,038 | 7/1956 | Barrett | 37/355 X |
| 3,307,276 | 3/1967 | Russell | 37/90 |
| 3,627,036 | 12/1971 | Gilbert | 198/952 X |
| 4,223,462 | 9/1980 | Morris | 37/86 |
| 4,626,032 | 12/1986 | Harris et al. | 299/36 |
| 4,720,929 | 1/1988 | Umberson | 37/91 |
| 4,755,001 | 7/1988 | Gilbert | 299/39 |
| 4,786,111 | 11/1988 | Yargici | 299/81 X |
| 5,005,304 | 4/1991 | Briscoe et al. | 172/751 X |
| 5,209,001 | 5/1993 | Gilbert | 37/357 |
| 5,219,380 | 6/1993 | Young et al. | 37/359 |

FOREIGN PATENT DOCUMENTS

| | | |
|---|---|---|
| 208186 | 3/1984 | Germany . |
| 968195 | 10/1982 | Sweden . |

*Primary Examiner*—Randolph A. Reese
*Assistant Examiner*—Robert Pezzuto
*Attorney, Agent, or Firm*—Marcus L. Bates

[57] ABSTRACT

A ground supported excavating machine of the type having a main frame and a prime mover for propelling the machine along the ground, and a boom supported from the frame that has an endless chain type digging member rotated by sprockets on a head shaft that is mounted at one end of the boom, and on a tail wheel shaft mounted at the opposed end thereof, to provide a lower run that engages the lower surface of the boom. The interior of the boom is made into a liquid container that communicates with the bottom surface of the boom, which is filled with sufficient liquid to transfer heat from the relatively hot boom lower surface to a relatively cold boom surface. A wear plate assembly is mounted to the lower surface of the boom and covers the lower surface of the boom near the tail wheel sprockets, and isolates the upper surface of the wear plates from the lower surface of the boom by suspending the wear plates for loosely contacting the boom lower surface with very little force respective to the force with which the lower run engages the lower surface of the boom while digging.

23 Claims, 2 Drawing Sheets

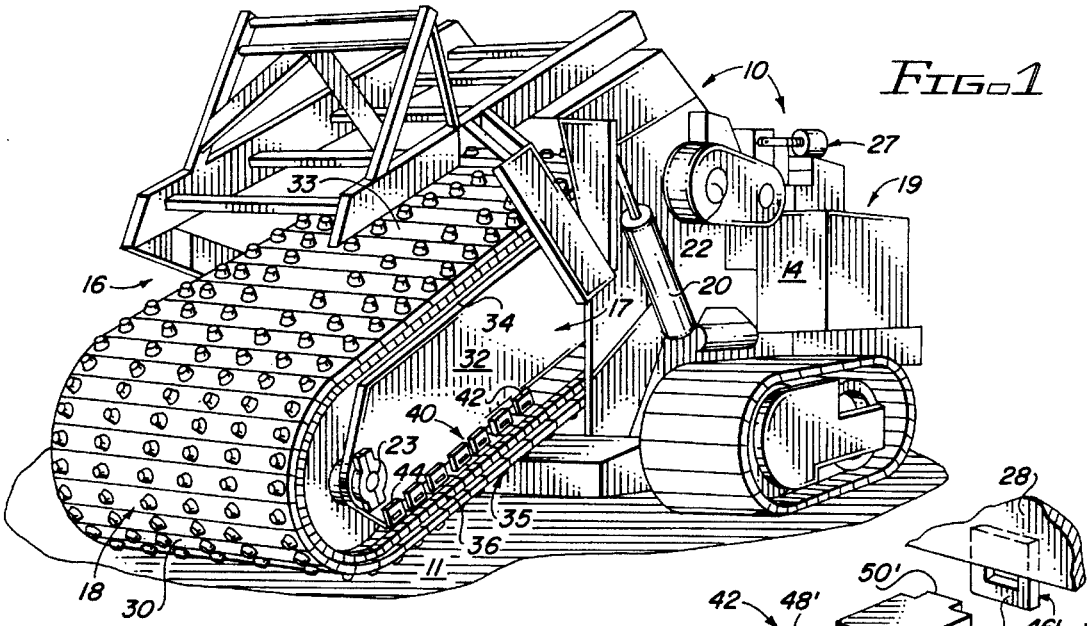
FIG. 1
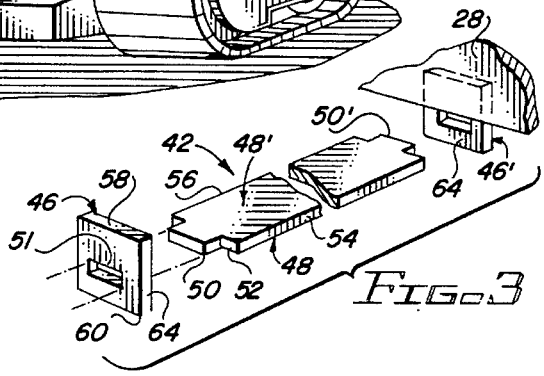
FIG. 3
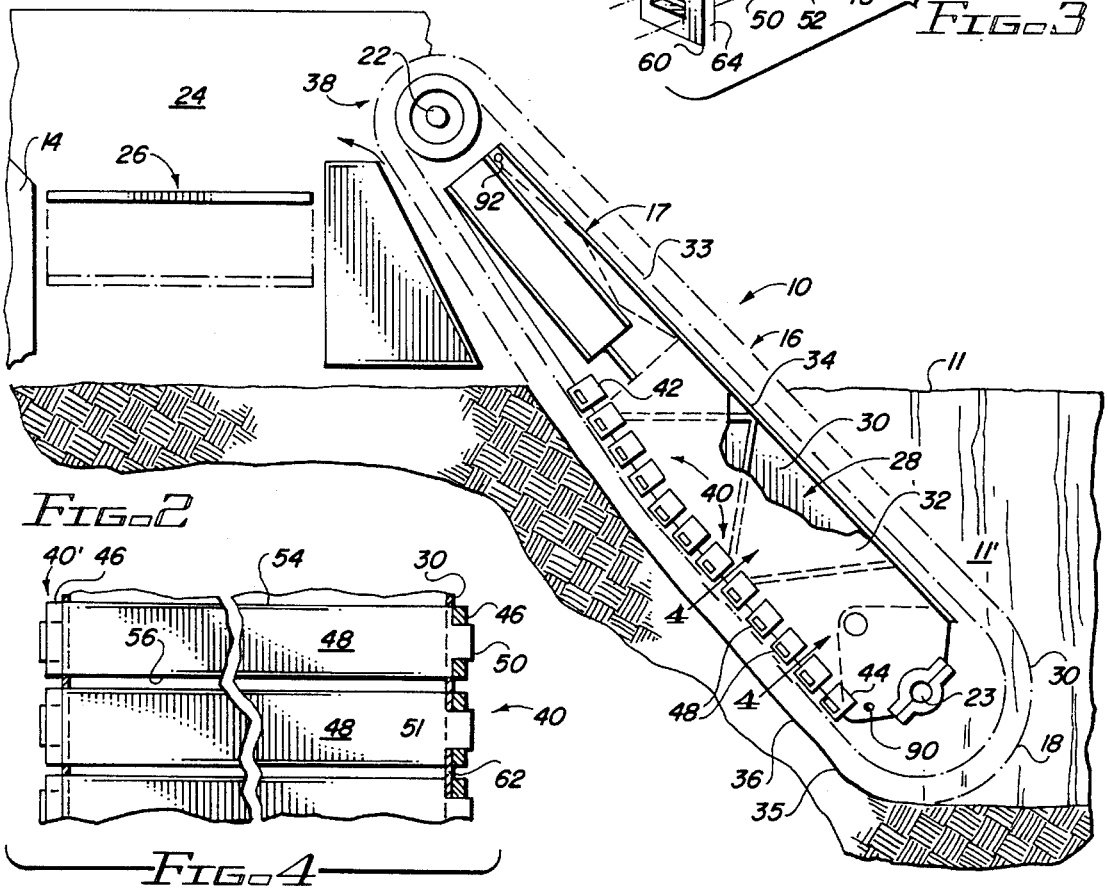
FIG. 2
FIG. 4

METHOD AND APPARATUS FOR COOLING CHAIN TYPE DIGGERS

BACKGROUND OF THE INVENTION

Digging deep excavations, such as cross-country ditches, necessitates that a considerable amount of material is removed from the ground in order to provide a ditch bottom which is constructed at a specific elevation, or grade. Construction of deep ditches and other excavations usually requires a ladder type digging apparatus, such as shown, for example, in my previous patent, U.S. Pat. No. 4,755,001, and in my co-pending patent application Ser. No. 08/245,942 filed May 19, 1994, entitled "WIDE TRENCHER WITH PLURALITY OF CHAIN TYPE DIGGERS". My previous patent, U.S. Pat. No. 4,755,001, and my co-pending patent application each disclose an excavating machine having a ladder type digging apparatus that translocates excavated material from the ditch by means of the lower run of the digging member, up through a throat, and then along a lateral conveyor to a location spaced from the excavating machine. The dissipation of the enormous digging force applied to the lower run of the ladder type digging apparatus results in very high temperatures being generated on the lower surface of the boom, especially the marginal free depending end near the tail wheel of the boom, because of the forces involved as the lower run of the digging member engages and excavates the ground. The generated high temperatures accelerate wear between the co-acting parts of the digging apparatus, and this brings about costly repairs which usually also results in expensive downtime.

In the past, wear plates are arranged on the boom to accept wear caused by the friction associated with the lower run of the endless digging chains of the digging apparatus. The wear plates are usually installed by direct fixation by welding the plates directly to the underside of the boom where the heat generated therein is rapidly transferred into all of the moving parts associated with the plates. This generated heat creates premature malfunction of the boom parts due to the high operating temperatures, which accelerates the wear rate, and thereby many causes many difficult repair problems. Further, replacement of the fixed wear plates is difficult to effect in the field, and is a time consuming, expensive, and difficult task.

The present invention overcomes many of the above problems by the provision of a fluid cooled boom in combination with improvements in wear plates which are designed to be inexpensively replaced in the field. Another important feature of the invention is the arrangement of the wear plates to readily dissipate heat to the atmosphere rather than transfer the heat directly into the boom parts, including the lower run of the digging member. Thus, the invention dissipates heat into the atmosphere while at the same time heat that is transferred from the improved wear plates into the bottom of the boom is rapidly removed from a high temperature region to relatively cooler parts of the boom where it is dissipated by convection and radiation into the atmosphere. Method and apparatus by which these desirable and novel achievements are realized are the subject of the present invention.

SUMMARY OF THE INVENTION

This specification sets forth the precise invention for which a patent is solicited, in such manner as to distinguish it from other inventions and from what is old. This invention comprises improvements in an excavating machine for digging a ditch, and comprises a main frame that supports a prime mover having a drive train connected for propelling the machine along the ground. In the preferred form of the invention, the main frame supports an elongated digging apparatus that includes an elongated boom having a ladder type endless digging member supported thereon.

Means pivotally mount the boom near end to the trailing end of the main frame. Means connect the prime mover for rotating the sprockets located on the head shaft, thereby enabling the excavation process to be carried out. Further, spaced endless drive chains are meshed with the head shaft sprockets and the tail wheel shaft sprockets to thereby provide an upper run and a lower run of endless digging chain. Suitable earth removing implements, such as digging teeth, are mounted on lateral members located between the endless chains to form an endless digging and conveying member by which material is excavated from the ground and translocated to a conveyor means for receiving material from the endless digging and conveying member and for moving any excavated material from proximity of the digging machine.

The boom is filled with liquid for cooling the boom by natural or forced circulation. The tensioned lower run of the endless digging member is separated from the bottom of the boom by replaceable special wear plates, arranged in accordance with this invention, to dissipate heat generated by the digging action away from the moving parts of the lower run and thereby elongating the life of the moving parts.

Therefore, the present invention provides a fluid cooled boom in combination with improvements in wear plates, wherein the wear plates are designed to be inexpensively replaced in the field. The novel arrangement of the wear plates readily dissipates heat to the atmosphere rather than transferring the heat directly into the boom parts, including the lower run of the digging member. Thus the invention dissipates heat from the digging machine into the atmosphere while at the same time that heat which is transferred from the improved wear plates into the bottom of the boom is rapidly removed from the high temperature area to other cooler parts of the boom where the heat is dissipated by convection and radiation into the atmosphere.

A primary object of the present invention is the provision of an excavating machine having an elongated pivoted digging apparatus that includes a plurality of digging members for excavating material, with there being a plurality of wear plates interposed between the lower face of the boom and the lower run of the digging apparatus, all arranged in a manner to reduce the wear rate of the co-acting parts of the digging members.

Another object of the invention is the provision of an excavating machine having an elongated digging apparatus pivotally attached to a boom thereof, with there being a ladder type endless digging member included thereon which digs and conveys excavated material away therefrom, with the endless digging member being arranged to dig with the lower run of the chain tensioned, and with there being improved wear plates interposed between the lower run and the bottom of the boom which reduce the heat transferred into the lower run of the digging member.

A further object of this invention is to disclose and provide an excavating machine having an excavating apparatus pivotally mounted to one end thereof, wherein the excavating apparatus is comprised of a boom mounted digging member having digging teeth attached thereto for excavating and conveying the excavated material, with the boom being liquid filled to dissipate heat generated by the digging process away from the hottest parts of the boom to thereby reduce the wear rate of the moving parts associated with the digging member and boom.

Another and still further object of this invention is the provision of an excavating machine having a liquid cooled boom to which there is mounted an elongated digging apparatus pivotally attached to the frame of the machine, with there being means, including the liquid cooled boom and special wear plates, by which the endless digging member is cooled.

An additional object of the present invention is the provision of an unusually efficient digging machine having a main body which moves along the ground and supports an elongated digging apparatus, including a liquid cooled boom, from one end thereof, and an endless digging member having a tensioned lower run which is separated from the bottom of the boom by replaceable wear plates arranged to dissipate heat generated by the digging action away from the moving parts of the lower run.

Another and still further object of this invention is the provision of an excavating machine having a combination liquid cooled boom and replaceable wear plates which cooperate together to cool and therefore reduce the wear rate of the moving parts of the endless digging member.

These and various other objects and advantages of the invention will become readily apparent to those skilled in the art upon reading the following detailed description and claims and by referring to the accompanying drawings.

The above objects are attained in accordance with the present invention by the provision of both method and apparatus which is carried out by means of a combination of elements which are fabricated in a manner substantially as described herein.

BRIEF DESCRIPTION OF THE DRAWINGS

FIG. 1 is a three-quarter, rear, perspective view of a digging machine made in accordance with the present invention;

FIG. 2 is a part schematical, part diagrammatical, part cross-sectional side view of a digging machine made in accordance with this invention, with some parts being broken away therefrom and some of the remaining parts being shown in cross-section;

FIG. 3 is an enlarged, broken, dissembled, perspective view which sets forth additional details of the apparatus disclosed in the foregoing figures;

FIG. 4 is a detailed, enlarged, broken, top plan view of part of the apparatus of FIG. 2 and discloses some additional details of thereof;

DETAILED DESCRIPTION OF THE PREFERRED EMBODIMENTS

Figure 5:
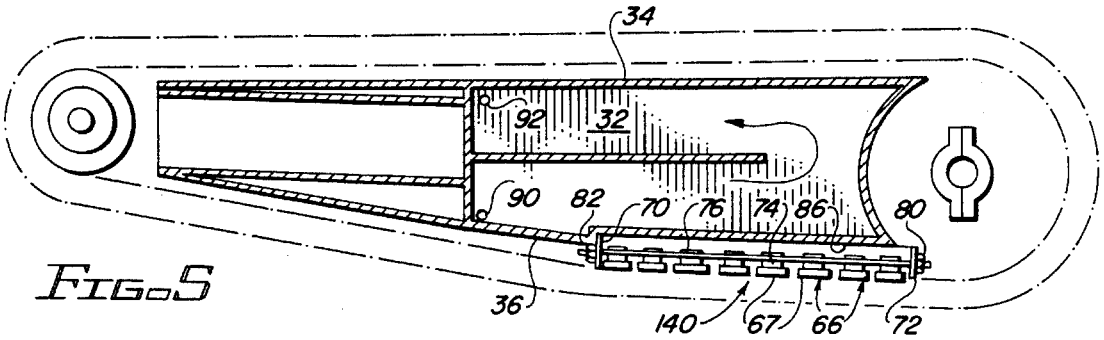
FIG. 5 is a part cross-sectional, side view showing an alternate embodiment of the invention.

The figures of the drawings illustrate important details of an excavating machine 10, made in accordance with this invention for digging a deep ditch 11 into the ground 11'. As best illustrated in FIGS. 1 and 2, the excavating machine 10 is supported on a set of tracks 12 and includes a main frame 14. A ladder type endless digging and conveying apparatus 16, made in accordance with this invention, and hereinafter referred to as an endless digging apparatus 16, includes a main support boom 17 therein which is attached to and extends from the trailing end of the main frame 14. Numeral 18 indicates the tail end of the endless digging apparatus 16 while numeral 19 indicates a prime mover that preferably is located at the forward end of the main frame 14 for propelling the excavating machine 10 along the ground 11' and for powering the endless digging apparatus 16.

In FIG. 1, hydraulic cylinders 20 are interconnected between the boom 17 and the main frame 14 to pivotally mount the endless digging apparatus 16 for movement within a vertical plane. A head shaft 22 pivotally connects the near end of the boom 17 to the far end of the main frame 14 as shown in greater detail in my previous U.S. Pat. No. 4,755,001.

As seen in FIG. 2, the main frame 14 has lateral opening 24 formed therein for accommodating a lateral conveyor 26 mounted thereto which extends though the openings 24 for translocating excavated material deposited thereon by endless digging apparatus 16. In FIG. 1, an operator's cab (not shown) is mounted at 27 respective to the main frame 4.

In FIGS. 1 and 2, together with other figures of the drawings, the boom 17 that supports the endless digging apparatus 16 is made into the illustrated liquid containing boom enclosure 28 that is formed by opposed sides 30, 32, an upper wall surface 34 opposed to a lower wall surface 36, and opposed end walls that are disposed adjacent head shaft 22 and tail shaft 23. This boom structure provides a water tight container which allows thermal or forced circulation of liquid to occur therein and thereby transfer heat from hot areas of the boom 17 (the area that rubs against the tight lower run of the endless digging apparatus 16) to cooler outer surface areas of the boom (the area near the upper run and the head shaft 22) to thereby dissipate heat from the enclosed heat transfer liquid.

In FIGS. 1–4, an upper run 33 of the endless digging apparatus 16 is supported on a marginal length of the upper boom wall surface 34 while a lower run 35 bears against the lower boom wall surface 36 while digging with a tight chain. A critical marginal length of the lower boom surface 36 is separated from the lower run 35 of the endless digging apparatus 16 by a wear plate assembly, generally indicated by the numeral 40, the details of which are best illustrated in FIGS. 3 and 4. As seen in FIG. 1 and 2, the wear plate assembly 40 of this invention includes a plurality of wear plate apparatus 42, 43, 44 which are mounted to extend along a lower marginal length of the boom 17, and between the opposed boom sidewalls 30, 32. The length of the entire wear plate assembly 40 is defined by the longitudinal distance measured between a first and a last wear plate apparatus 42 and 44, with there being a plurality of wear plate apparatus 43 located therebetween; all of which are disposed adjacent the lower boom surface 36, with the last of the wear plate apparatus 44 being located adjacent tail shaft 23, and the first of the wear plate apparatus 42 being spaced farthest from the tail shaft 23. The location of the wear plate assembly 40 defines the area on the endless digging apparatus 16 that develops the highest frictional temperatures.

In FIGS. 1–4, the wear plate assembly 40 is seen to comprise of a plurality of wear plate apparatus or attachments 43 that commences at attachment 44 and ends at attachment 42. The attachments each include a pair of confronting, spaced, mounting plates that are arranged in opposed pairs 46, 46', with each opposed pair of mounting plates 46, 46' capturing a wear plate 48 therebetween.

Each of the wear plates 48 has opposed faces 49, 49' and a central body 48' of rectangular configuration that present opposed marginal ends which are reduced in width to form opposed rectangular tangs 50, 50' projecting therefrom. Each opposed tang 50, 50' of each wear plate 48 is received within a slot 51 that is formed within the opposed mounting plates 46, 46', whereby each wear plate 48 has the upper face 49 thereof mounted in confronting relationship respective to the lower face or lower wall surface 36 of the boom 17, and with the upper face 49 of the wear plate 48 confronting and rubbing against the lower run 35.

FIGS. 3 and 4 show the details of the cooperative relationship of the mounting plates 45, 46' and wear plates 48, wherein (in FIG. 3) there is disclosed a dissembled wear plate apparatus 42, which is identical to wear plates 43 and 44. It is considered within the comprehension of this invention to bolt the pairs of mounting plates 46, 45' onto the opposed sidewalls 30, 32 of the boom 17 of the endless digging apparatus 16; and, to make all of the mounting plates on either side of the endless digging apparatus 16 from a single metallic member having a plurality of slots 51 formed therein for receiving the opposed tangs 50, 50' of the wear plates 48.

The opposed ends of the wear plates 48 each have a shoulder 52 that results from opposed edges, 54 and 56, being reduced in width to form the opposed tangs 50. The opposed shoulders 52 abut the confronting faces of the mount plates 46, 46'. The top edge 58 of the mount plates 46, 46' is opposed to the bottom edge 60 thereof. The top edge 58 is attached by a welding bead 62, for example, to the boom 17 and the opposed bottom edge 60 is located in underlying relationship respective to the boom bottom for receiving the wear plate tangs in the exposed slot 51 thereof.

The welding bead 62 preferably rigidly attaches the upper marginal end of the mounting plates 46, 46' along each opposed edge 64 thereof to the sidewalls 30, 32 of the boom 17.

The wear plate assembly 40 is supported at the marginal lower tail end of the boom, which disposes the assembly 40 in the area that generates the most heat as a result of the digging operation. The mounting plates 46, 46' are affixed to the opposed boom sides to receive and support a plurality of individual wear plates 48 which are arranged in sandwiched relationship between the lower wall surface 36 of the boom and the lower run 35 of the endless digging chain, with each wear plate 48 being arranged laterally respective to the lower run 35 and extend from proximity of tail shaft 23 towards the head shaft 22, and in parallel relationship respective to one another. Only one of the plates of a pair must be removed from the boom side for renewing the wear plates. Numeral 38 generally indicates the throat formed through main body 14 for receiving excavated material from the lower run 35.

Figure 6:
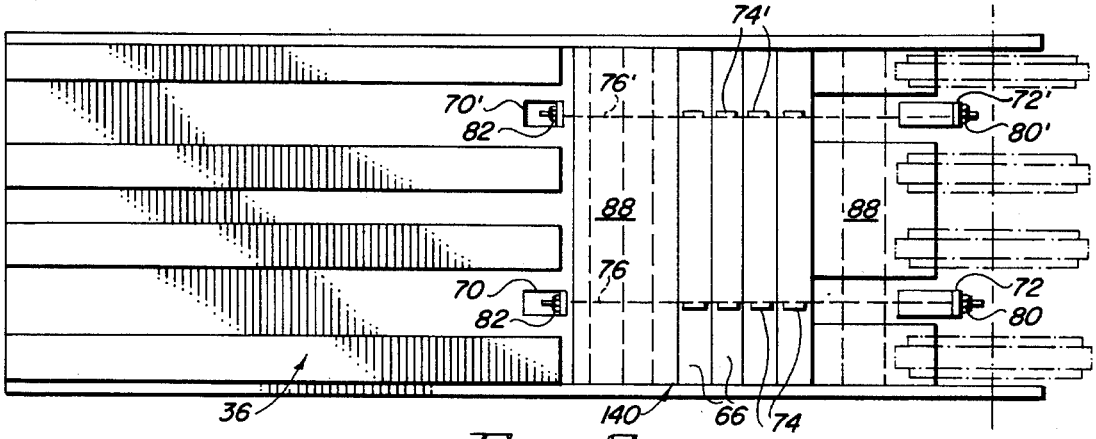
FIG. 6 is a fragmentary, part schematical, bottom plan view of part of FIGS. 5.
Figure 7:
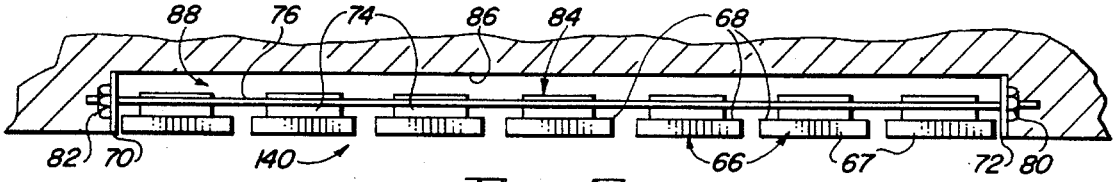
FIG. 7 is an enlarged, detailed, fragmentary, part schematical, side view of part of FIG. 6; and, FIG. 8 is an isolated, diagrammatic illustration of the apparatus of this invention.

FIGS. 5–7 disclose a second embodiment of the invention, and comprise a removable wear plate assembly 140 that runs somewhat cooler than the previously illustrated first embodiment seen at 40 in FIGS. 1–4 of the drawings. In FIGS. 5–7, the wear plate assembly 140 comprises a plurality of wear plates each having a lower wear face 67 opposed to an upper face 68. Each of the wear plates 66, are rectangular in configuration.

Spaced anchors 70, 72 are arranged in fixed relationship respective to the bottom or lower wall surface 36 of the endless digging apparatus 16. The anchors 70, 72 preferably are reinforced, apertured, rectangular members rigidly affixed, as by welding, in spaced relationship respective to the bottom wall surface 36 of boom 17. Anchor pair 70 and 72 are spaced longitudinally apart, and are also laterally spaced from an identical anchor pair 70' and 72'.

The upper face 68 of each wear plate 66 has a pair of support members 74, 74' affixed thereto and spaced from one another and from the opposed ends thereof. A tendon 76, preferably a chain, extends between members 70, 72 and 70', 72', respectively, and are anchored into position by threaded members 80, 82 by which adjustments in the tension in the tendon 76 can be made.

The tendon 76 is fastened to each of the support members 74, as noted by numeral 84, to thereby support each of the wear plates 66 closely adjacent to wall 86 that forms the roof of a recess 88 formed within the bottom or lower wall surface 36 of the boom 17. This arrangement places lower faces 67 of the wear plate members in the same horizontal plane with bottom surface 36 of the boom 17.

Figure 8:
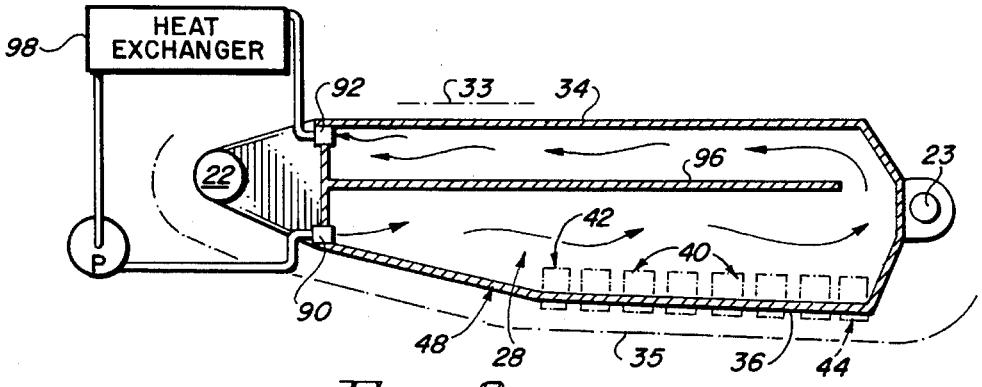

In FIGS. 2, 5, and 8, inlet 90 is located at the lower end of the boom for inflow of relatively cool liquid coolant. The relatively hot coolant is discharged at outlet 92. In FIG. 8, the boom is provided with a baffle plate 96 arranged for optimum coolant circulation within enclosure 28, wherein the coolant flows into inlet 90 and then down along the lower half of the boom interior where it removes heat from the high temperature area where the wear plate assembly, 40 or 140, is mounted. The coolant continues back up along the upper half of the boom to outlet 92, through the illustrated flow conduits into heat exchanger 98 where it is cooled and then is returned to the suction of the illustrated pump which forces coolant to flow into inlet 90.

The heat generated in the wear plates is dissipated into the atmosphere rather than directly flowing into the lower surface of the boom as in the prior art wear plates. This desirable reduction in temperature is achieved due to the wear plates being loosely mounted in confronting relationship respective to the lower surface of the boom so that heat flow must occur along a path towards the opposed ends of the wear plates and into the mounting plates before appreciable heat transfer can occur into the boom. Consequently, the wear plates of this invention cooperate with the concept of water cooling the boom to provide a combination having unexpected reduction in wear rate of all the moving parts affected by high temperatures.

In operation, the improved excavating machine for digging a ditch includes a main frame, a prime mover and a drive train for propelling the machine along the ground. The improved excavating machine also includes an elongated digging apparatus having a boom with a near end opposed to a far end, an upper surface opposed to a lower surface, and opposed sides. A head shaft is located at the near end of the boom and a tail shaft is located at the far end of the boom. A plurality of axially spaced sprockets are mounted on the head shaft and a plurality of axially spaced sprockets are mounted on the tail shaft. Means are provided for pivotally mounting the boom near end to the main frame of the excavating machine.

Spaced endless chains are connected about the sprockets on the head shaft and on the tail shaft to thereby provide an upper chain run at the upper surface of the boom and a lower chain run at the lower surface of the boom. Endless digging and conveying members are supported by the endless chains.

Means connecting the prime mover for rotating the head shaft sprockets move the endless chains between the sprockets on the head shaft and tail shaft. A conveyor receives excavated material from the endless digging and conveying member and moves the excavated material from proximity of the excavating machine.

The boom has a watertight, hollow interior. A heat transfer liquid circulates within the hollow interior and transfers heat generated by the lower run of the endless chain away from the lower surface of the boom to a relatively cooler part of the boom and thereby reduces the working temperature of the boom. The boom interior also includes baffles that form a liquid flow path along which the heated and cooled liquid circulating within the boom can flow. The cooling liquid can be circulated by convection or by a pump.

The lower surface of the boom is separated from the lower run by a plurality of wear plates which are arranged laterally respective to the lower chain run and in parallel relationship respective to one another. A plurality of mounting plates are affixed to opposed sides or the bottom of the boom and loosely secure a plurality of wear plates below the lower surface of the boom to enhance dissipation of heat from the wear plates into the atmosphere and the circulating cooling liquid rather than into the working parts of the boom. A slot is formed in the lower end of the mounting plates which extend below the boom lower surface for receiving a tang of the wear plates therein. The plurality of mounting plates can be attached to the sides or bottom of the boom by bolts, by welding or by chains.

When the excavating machine is operating, heat builds up in the working parts of the boom and the wear plates attached to the boom. The work heat is dissipated by the loosely attached wear plates and the cooling liquid circulating in the boom. As the wear plates are excessively worn or damaged, they easily can be replaced in the field by removing the bolted on, or welded on mounting plates, removing the worn wear plates, affixing new wear plates to the mounting plates which are then re-attached by bolts or welding to the boom. The down time of the excavating machine is minimal so the cost of replacing the wear plates in the field is reasonable and the machine can be put back to work in a short time.

I claim:

1. An improved excavating machine for digging a ditch; comprising:

a main frame; means including a prime mover and drive train for propelling said machine along the ground; an elongated digging apparatus that includes a boom having a near end opposed to a far end, an upper surface opposed to a lower surface, and opposed sides, a head shaft at the near end of said boom, a tail shaft at the far end of said boom, a plurality of axially spaced sprockets on said head shaft, a plurality of axially spaced sprockets on said tail shaft, means pivotally mounting said boom near end to said main frame;

spaced endless chains connected about said sprockets on said head shaft and said tail shaft to thereby provide an upper chain run at said upper surface and a lower chain run at said lower surface; means forming an endless digging and conveying member supported by said endless chains;

means connecting said prime mover for rotating said sprockets on said head shaft and thereby move said endless chains between said sprockets on said head shaft and said tail shaft; means receiving excavated material from the endless digging and conveying member and moving any excavated material from proximity of the excavating machine;

means forming a hollow interior within said boom, a heat transfer liquid within said hollow interior for transferring heat generated by the lower chain run away from the lower surface of said boom to a relatively cooler part of the boom and thereby reduce the temperature of the hottest part of the boom.

2. The excavating machine of claim 1 wherein said lower surface of said boom is separated from said lower chain run by a plurality of wear plates which are arranged laterally respective to the lower chain run and in parallel relationship respective to one another, and means capturing said plurality of wear plates respective to the lower surface of the boom; whereby, said plurality of wear plates are loosely received against said lower surface of said boom to thereby enhance dissipation of heat from said plurality of wear plates into the atmosphere rather than into said boom.

3. The excavating machine of claim 2 wherein said means capturing said plurality of wear plates include a mounting plate having opposed faces and an upper end opposed to a lower end; means attaching the upper end of a mounting plate to opposed sides of the boom, with the lower end of the mounting plate extending below said boom lower surface; a slot formed in said lower end;

each of said wear plates has a central body of rectangular configuration to present opposed ends, a marginal length of said opposed ends are reduced in width to form a tang projecting from each opposed end; said tang is received within said slot whereby each said wear plate has the upper face thereof confronting the lower surface of said boom.

4. The excavating machine of claim 3 wherein there is a mounting plate for receiving each said tang;

and further including baffle means within said boom interior for forming a flow path along which the heated and cooled liquid circulating within said boom can flow.

5. The excavating machine of claim 2 wherein said plurality of wear plates are of rectangular configuration to present a central body part and opposed ends, said means capturing includes an attachment on a central body part of each of said plurality of wear plates; spaced tension plates attached to said lower surface of said boom, a tendon having opposed ends adjustably received by said spaced tension plates, said wear plates being arranged to place said tendon parallel to said lower chain run; said attachment is connected to said tendon to orient each said wear plates laterally respective to the lower chain run and in parallel relationship respective to one another.

6. The excavating machine of claim 5 wherein there is a cavity formed within the lower surface of said boom, said means capturing said plurality of wear plates include spaced apart attachments received within said cavity to interpose said wear plates between the lower boom surface and the lower chain run.

7. The excavating machine of claim 5 wherein said plurality of wear plates includes spaced apart said attachment on said central body part of each of said plurality of wear plates, and spaced apart said tendon for connection to each said attachment to thereby mount said wear plates in captured relationship respective to said lower boom surface and between said lower boom surface and said lower chain run.

8. A digging machine for excavating material from the ground comprising a main frame having a prime mover supported thereon, a drive train connected for moving said machine along the ground; an elongated digging apparatus that includes a boom having a near end opposed to a far end, an upper boom surface opposed to a lower boom surface, and opposed sides that form a hollow interior, means mounting an endless digging and conveying member for longitudinal movement on said boom to provide an upper run at said upper boom surface, and a lower run at said lower boom surface, with said lower run adapted to engage and excavate the ground; means for receiving excavated material from the endless digging and conveying member and moving the excavated material from proximity of the digging machine; the improvement comprising:

said lower boom surface is separated from said lower run by a plurality of wear plates; mount means by which said wear plates are arranged laterally respective to the lower run and in parallel relationship respective to one another;

said plurality of wear plates being mounted in captured relationship respective to said lower boom surface at a location closely adjacent and spaced from said far end and remotely spaced from said near end; and, a heat transfer liquid within the boom hollow interior for transferring heat generated by the lower run of the endless digging and conveying member away from the lower boom surface to a relatively cooler part of the boom and thereby reduce the temperature of the lower boom surface.

9. The improvement of claim 8 wherein the means mounting said plurality of wear plates include a mounting plate having opposed faces and an upper end opposed to a lower end, with the upper end being attached to the opposed sides of said boom and the lower end extending below said lower boom surface, a slot in said lower end of said mounting plate; and, each of said wear plates has a central body of rectangular configuration to present opposed ends, a marginal length of said opposed ends are reduced in width to form a tang projecting from each opposed end; said tang is received within said slot whereby each said wear plate has an upper face thereof confronting the lower boom surface, and a lower face thereof confronting the lower run of the endless digging and conveying member.

10. The improvement of claim 9 wherein there is a mounting plate for receiving each said tang;

and further including baffle means within said boom interior for forming a flow path for the heated and cooled liquid circulating within said boom.

11. The improvement of claim 8 wherein said plurality of wear plates are of rectangular configuration to present a central body part having an upper face and a lower face and opposed ends, said means mounting includes an attachment on said central body part of said upper face of each of said plurality of wear plates; spaced tension plates attached to said lower boom surface, a tendon having opposed ends received by said spaced tension plates and arranged to place said tendon parallel to said lower run; said attachment is connected to said tendon to orient each of said wear plates laterally respective to the lower run and in parallel relationship respective to one another.

12. A ground supported excavating machine for excavating material from the earth, comprising:

a main frame having a prime mover and drive train for moving said machine along the ground; a digging apparatus that includes an elongated boom having opposed ends, a head shaft mounted at one end of said boom and a tail shaft mounted at the opposed end of the boom;

said one end of said boom is attached to said main frame and said opposed end depends therefrom;

said boom has an upper surface opposed to a lower surface; an endless digging chain supported for movement on said boom between the head and tail shafts and having a tight lower run that rubs against the boom lower surface;

a plurality of wear plates of rectangular configuration, each presenting a central body part and opposed ends; means, including an attachment on said central body part of each of said plurality of wear plates, by which said plurality of wear plates are mounted in underlying relationship respective to said boom lower surface;

spaced anchor plates attached to said lower surface of said boom, a tendon having opposed ends received by said spaced anchor plates and arranged to place said tendon parallel to said lower run; said attachment is connected to said tendon to orient each of said wear plates laterally respective to the lower run and in parallel relationship respective to one another.

13. The excavating machine of claim 12 wherein said plurality of wear plates are mounted in captured relationship respective to said lower surface of said boom and arranged at a location closely adjacent and spaced from the tail shaft and remotely spaced from the head shaft.

14. The excavating machine of claim 12 wherein the lower surface of said boom is separated from said lower run by said plurality of wear plates which are loosely received against said lower surface of said boom to thereby enhance dissipation of heat from said plurality of wear plates into the atmosphere rather than into said boom.

15. The excavating machine of claim 8 wherein said mount means include a mounting plate having opposed faces and an upper end opposed to a lower end, with the upper end being attached to the opposed sides of said boom, and the lower end extending below said lower boom surface, there being a slot in said lower end; and, each of said wear plates has a central body and opposed ends, a marginal length of said opposed ends is received within said slot whereby each said wear plate has the upper face thereof confronting the lower boom surface.

16. The excavating machine of claim 8 wherein said plurality of wear plates include a mounting plate having opposed faces and an upper end opposed to a lower end with the upper end being attached to said boom and the lower end extending below said lower boom surface, and, each of said wear plates has a central body and opposed ends, a marginal length of said opposed ends is received by the lower end of the mounting plate, whereby each said wear plate has the upper face thereof confronting the lower boom surface.

17. The excavating machine of claim 12 wherein said boom having opposed sides that form an enclosure in conjunction with the upper surface and lower surface thereof, a liquid within said enclosure;

and further including baffle means within said boom enclosure for forming a flow path by which heated and cooled liquid circulating within said boom enclosure can follow.

18. The digging machine of claim 8 wherein said plurality of wear plates are of rectangular configuration to present a central body part and opposed ends, said mount means includes an attachment on said central body part of each of said plurality of wear plates; spaced tension plates attached to said lower boom surface, a tendon having opposed ends adjustably received by said spaced tension plates and arranged to place said tendon parallel to said lower run; said attachment is connected to said tendon to orient each of said wear plates laterally respective to the lower run and in parallel relationship respective to one another.

19. The excavating machine of claim 18 wherein there is a cavity formed within the lower boom surface said means mounting said plurality of wear plates, including said spaced tension plates, is received within said cavity to interpose said wear plates between the lower boom surface and the lower run.

20. In a ground supported excavating machine of the type having a main frame and a prime mover for propelling the machine along the ground, a boom supported from the frame and having an upper surface and a lower surface and an endless digging member rotated by a head shaft mounted at one end of said boom and a tail shaft mounted at the opposed end thereof to provide a lower run that engages the lower surface of the boom and thereby raises the temperature of the lower surface respective to the upper surface; the method of reducing the rate of wear of the co-acting parts associated with the endless digging member comprising the steps of:

making the interior of the boom into a liquid container that communicates with the lower surface of the boom, and filling the interior with sufficient heat transfer liquid to thereby transfer heat from the relatively hot boom lower surface to a relatively cold boom upper surface;

removably mounting a plurality of wear plates having upper and lower faces in captured relationship respective to the lower surface of the boom and thereby cover a marginal length of the lower surface of the boom at a location adjacent the tail shaft, and isolating an upper face of the wear plates from the lower surface of the boom by suspending the wear plates for loosely contacting the lower surface of the boom with very little force respective to the force with which the lower run engages the lower face of the wear plates while digging.

21. The method of claim 20 and further including the steps of:

mounting downwardly directed spaced tension plates respective to said lower surface of the boom;

mounting a tension member having opposed ends adjustably received by said spaced tension plates and arranged to place said tension member parallel to said lower run;

connecting said tension member to orient each said wear plates laterally respective to the lower run and in parallel relationship respective to one another.

22. The method of claim 21 and further including the steps of dissipating heat generated by the friction of said lower run on said wear plates by mounting said plurality of wear plates in captured relationship respective to said lower surface of said boom, and arranged at a location closely adjacent and spaced from said tail shaft and remotely spaced from said head shaft.

23. The method of claim 20 and further including the steps of separating the lower surface of said boom from said lower run by arranging a plurality of wear plates laterally respective to the lower chain run and in parallel relationship respective to one another, and capturing said plurality of wear plates for limited movement respective to said boom lower surface;

whereby, said plurality of wear plates are loosely received against said lower surface of said boom to thereby enhance dissipation of heat from said plurality of wear plates into the atmosphere rather than into said boom.

* * * * *